US008818220B2

(12) United States Patent
Nakaso et al.

(10) Patent No.: US 8,818,220 B2
(45) Date of Patent: Aug. 26, 2014

(54) IMAGE FORMING APPARATUS, OUTPUT DEVICE, COMPUTER-READABLE MEDIUM AND RECORDING MEDIUM

(75) Inventors: Suguru Nakaso, Kanagawa (JP); Yuka Ito, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 208 days.

(21) Appl. No.: 13/195,540

(22) Filed: Aug. 1, 2011

(65) Prior Publication Data

US 2012/0177410 A1 Jul. 12, 2012

(30) Foreign Application Priority Data

Jan. 11, 2011 (JP) ..... 2011-003291

(51) Int. Cl.
*G03G 15/01* (2006.01)
*G03G 15/36* (2006.01)

(52) U.S. Cl.
CPC ..... *G03G 15/36* (2013.01); *G03G 2215/0129* (2013.01); *G03G 15/0189* (2013.01)
USPC ..... 399/53; 399/223

(58) Field of Classification Search
USPC ..... 399/53, 223
See application file for complete search history.

(56) References Cited

U.S. PATENT DOCUMENTS 6,548,768 B1 4/2003 Pettersson et al.
6,663,008 B1 12/2003 Pettersson et al.
6,674,427 B1 1/2004 Pettersson et al.
7,172,131 B2 2/2007 Pettersson et al.
7,248,250 B2 7/2007 Pettersson et al.
7,281,668 B2 10/2007 Pettersson et al.
7,588,191 B2 9/2009 Pettersson et al.
7,876,460 B2 1/2011 Yoshida
2004/0095337 A1 5/2004 Pettersson et al.
2004/0113893 A1 6/2004 Pettersson et al.
2004/0113898 A1 6/2004 Pettersson et al.
2005/0104861 A9 5/2005 Pettersson et al.
2006/0076416 A1 4/2006 Pettersson
2007/0030503 A1* 2/2007 Tonami ..... 358/1.9
2007/0196133 A1* 8/2007 Kubo ..... 399/223
2008/0088860 A1 4/2008 Yoshida
2008/0192102 A1* 8/2008 Leenders et al. ..... 347/102
2008/0260397 A1* 10/2008 Itagaki ..... 399/39
2010/0096458 A1 4/2010 Pettersson et al.

FOREIGN PATENT DOCUMENTS

JP A-2003-511761 3/2003
JP A-2007-274736 10/2007
WO WO 2006/040832 A1 4/2006

* cited by examiner

*Primary Examiner* — Walter L Lindsay, Jr.
*Assistant Examiner* — Philip Marcus T Fadul
(74) *Attorney, Agent, or Firm* — Oliff PLC

(57) ABSTRACT

An image forming apparatus includes a first image-forming material that contains a colored pigment and a second image-forming material that contains the colored pigment having a concentration lower than that of the first image-forming material, a first image forming unit that forms a code image representing encoded information on a recording medium using the second image-forming material, and a second image forming unit that forms a non-code image at a position other than the position of the code image on the recording medium using an image-forming material other than the second image-forming material.

9 Claims, 11 Drawing Sheets

IMAGE FORMING APPARATUS, OUTPUT DEVICE, COMPUTER-READABLE MEDIUM AND RECORDING MEDIUM

CROSS-REFERENCE TO RELATED APPLICATIONS

This application is based on and claims priority under 35 USC 119 from Japanese Patent Application No. 2011-003291 filed Jan. 11, 2011.

BACKGROUND (i) Technical Field

The present invention relates to an image forming apparatus, an output device, a non-transitory computer-readable medium, and a non-transitory recording medium.

(ii) Related Art

When an image (code image) representing encoded information such as a barcode or a two-dimensional code is formed on a recording medium, a technique of making the formed code image unobtrusive to the human eye is known.

SUMMARY

According to an aspect of the invention, there is provided an image forming apparatus including: a first image-forming material that contains a colored pigment and a second image-forming material that contains the colored pigment having a concentration lower than that of the first image-forming material; a first image forming unit that forms a code image representing encoded information on a recording medium using the second image-forming material; and a second image forming unit that forms a non-code image at a position other than the position of the code image on the recording medium using an image-forming material other than the second image-forming material.

BRIEF DESCRIPTION OF THE DRAWINGS

Exemplary embodiments of the present invention will be described in detail based on the following figures, wherein.

DETAILED DESCRIPTION

First Embodiment

Hereinafter, exemplary embodiments of the invention will be described with reference to the accompanying drawings. First, a first embodiment of the invention will be described.

Figure 1:
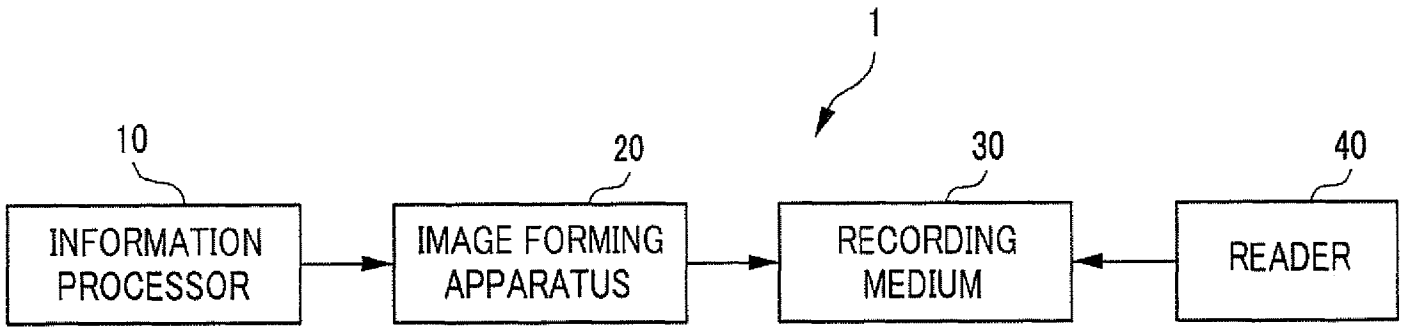
FIG. 1 is a block diagram illustrating the entire configuration of an image processing system according to an exemplary embodiment of the invention.

FIG. 1 is a block diagram illustrating the entire configuration of an image processing system 1 including an image forming apparatus 20 according to the first embodiment of the invention for the purpose of describing the image forming apparatus 20. The image processing system 1 includes an information processor 10, an image forming apparatus 20, a recording medium 30, and a reader 40.

The information processor 10 is an apparatus such as a personal computer having a function of processing data (image data) representing an image, or the like. The information processor 10 generates image data (hereinafter, referred to as "entirety of the image data") representing the entire image including a code image, which represents encoded information by the use of a shape, a size, an arrangement, and the like and outputs the generated entirety of the image data to the image forming apparatus 20. The information processor 10 may acquire and store the entirety of the image data from an external device not shown.

The image forming apparatus 20 includes plural types of image-forming materials forming images of different colors when they are transferred onto a recording medium, and forms an image on the recording medium 30 using at least one of the image-forming materials. The image-forming materials are, for example, toner or ink, and are toner in this embodiment. The recording medium 30 is a medium formed of paper or resin and the toner is transferred to the surface thereof to form an image. In this embodiment, the recording medium 30 is a white-background medium. The reader 40 is a device that recognizes the shape, the size, the arrangement, or the like of the code image and that reads the encoded information represented by the code image. Specifically, the reader 40 applies light of a predetermined wavelength (hereinafter, referred to as "reading light") for reading the code image to the code image and recognizes the code image on the basis of the strength and weakness of the reflected light.

Figure 2:
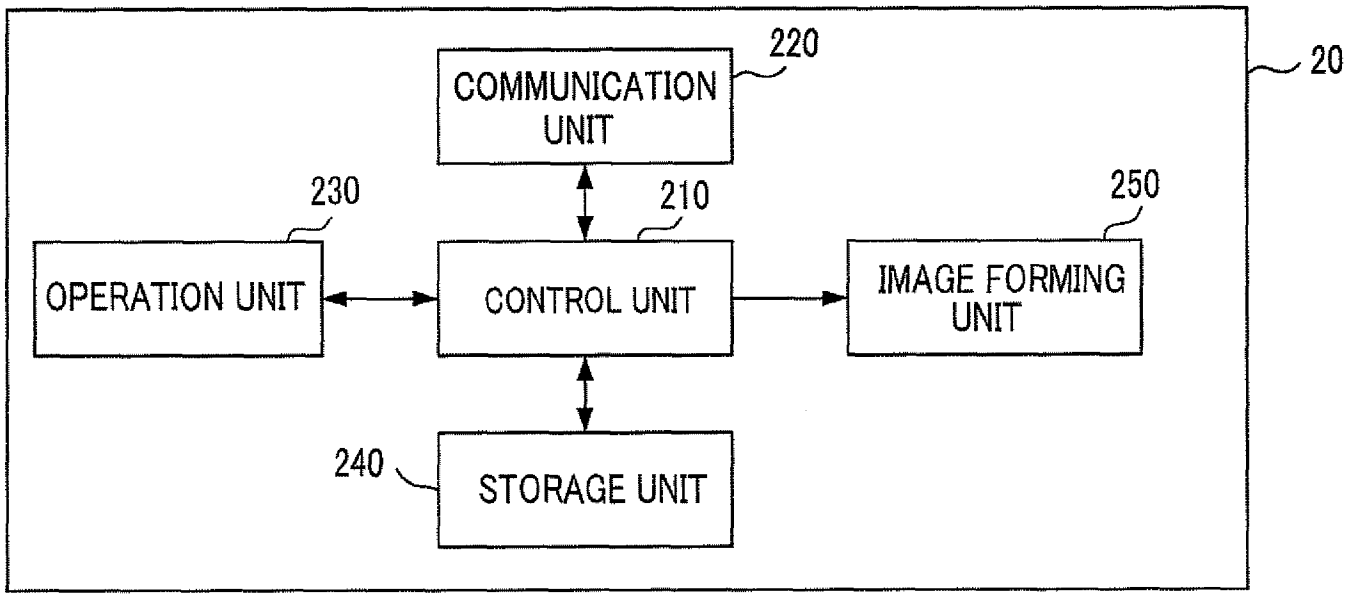
FIG. 2 is a block diagram illustrating the hardware configuration of an image forming apparatus.

The hardware configuration of the image forming apparatus 20 will be described below with reference to FIG. 2.

The image forming apparatus 20 includes a control unit 210, a communication unit 220, an operation unit 230, a storage unit 240, and an image forming unit 250. The control unit 210 includes a central processing unit (CPU), a read only memory (ROM), and a random access memory (RAM). The CPU constructs various functional blocks by loading a functional program stored in the ROM or the storage unit 240 into the RAM and executing the functional program. The RAM also serves as an area used to temporarily store data and the like when the CPU executes the functional program.

The communication unit 220 includes an interface used to transmit and receive data to and from an external device, and receives image data transmitted, for example, from the information processor 10 shown in FIG. 1. The operation unit 230 includes operation elements such as buttons and supplies operation data representing the operation details to the control unit 210 in accordance with a user's operation. The storage unit 240 includes a storage device such as a hard disk drive (HDD) and stores, for example, the entirety of the image data or code image data to be described later.

The image forming unit 250 is, for example, a printer forming an image by electrophotography and performs charging, exposure, developing, transfer, fixing, and the like.

The image forming unit 250 includes toner of five colors of Y (yellow), M (magenta), C (cyan), K (black), and Gy (gray). The image forming unit 250 transfers the toner to the recording medium 30 shown in FIG. 1 to form an image thereon.

The toner of K contains a pigment (black pigment) representing black when an image is formed on the recording medium 30 therewith. The toner of Gy contains the black pigment common to the toner of K and the concentration of the black pigment is lower than that of the toner of K. The black pigment is an example of the "colored pigment" described in the above-mentioned aspect. The toner of Gy represents a color (gray) of which the concentration is lower than that of the color (black) represented by the toner of K when an image is formed on the recording medium 30 therewith. Here, the concentration of a color is expressed by a ratio of light reflected from an object (the toner with which an image is formed on a recording medium) to light incident on the object. In the case of black, the concentration becomes lower as the reflectance of light of a visible wavelength becomes higher, and the concentration becomes higher as the reflectance becomes lower. In this embodiment, it is assumed that light transmitted by the object is not considered.

The color (gray) of the image formed with the toner of Gy has a smaller color difference from the color (white) of the recording medium 30 than the color (black) of the image formed with the toner of K. Here, the color difference means a distance in a color space of two colors. For example, the color difference in the L*a*b* color system is calculated by squaring and summing the difference in L* between two colors, the difference in a*, and the difference in b* and taking the square root of the resultant. The color difference is not limited to the color difference in the L*a*b* color system, but any may be used, as long as the difference between two colors becomes smaller and the two colors becomes indistinguishable to the human eye as the color difference becomes smaller. That is, the image formed with the toner of Gy is an image more indistinguishable from the color of the recording medium 30 by the human eye than the image formed with the toner of K. The toner of K is an example of the "first image-forming material" described in the above-mentioned aspect and the toner of Gy is an example of the "second image-forming material" described in the above-mentioned aspect. The toners of Y, M, and C different from either of the toner of K or the toner of Gy are examples of the "third image-forming material" described in the above-mentioned aspect.

Figure 3:
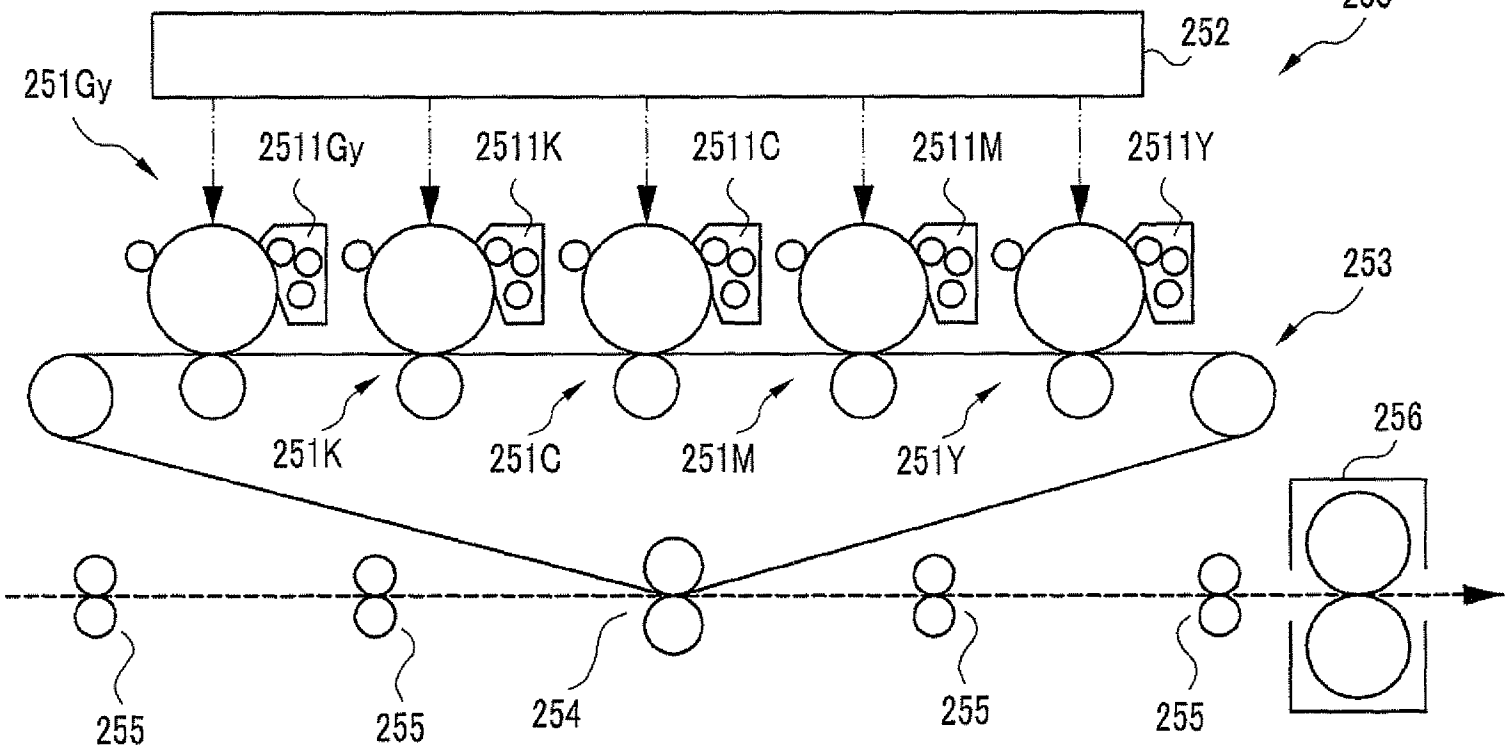
FIG. 3 is a diagram illustrating the configuration of an image forming unit.

FIG. 3 is a diagram illustrating the configuration of the image forming unit 250. The image forming unit 250 includes primary transfer units 251Y, 251M, 251C, 251K, and 251Gy, an exposure unit 252, an intermediate transfer unit 253, a secondary transfer unit 254, plural carrying rolls 255, and a fixing unit 256. The primary transfer units 251 include a photosensitive drum, a charging device, developing devices 2511Y, 2511M, 2511C, 2511K, and 2511Gy, and a primary transfer roll. The intermediate transfer unit 253 includes an intermediate transfer belt and plural rotating rolls. The secondary transfer unit 254 includes a secondary transfer roll and a backup roll. Among the reference numerals in the image forming unit 250, the reference numerals having suffix letters (Y, M, C, K, or Gy) mean that the corresponding reference numeral is associated with the formation of a color image corresponding to the letter. The reference numerals having different suffix letters mean that they are different in position or toner but are equal in configuration. When it is not necessary to particularly distinguish the configurations, the suffix letters of the reference numerals are removed.

In the image forming unit 250, an image is formed on the recording medium carried in the direction of the dotted arrow shown in FIG. 3. The photosensitive drum is a cylindrical member in which a photoconductive film is stacked on the surface thereof. The charging device charges the photoconductive film of the photosensitive drum to a predetermined potential. The exposure unit 252 is controlled in exposure intensity or exposure position by the control unit 210 and applies light to (exposes) the charged photosensitive drum to form an electrostatic latent image corresponding to the exposing light. The developing devices 2511 are devices that supply toner of five colors and develop the toner of the respective colors in the electrostatic latent image formed on the corresponding photosensitive drums. The developing devices 2511 cause a potential difference from the photosensitive drum and move the charged toner to the surface of the photosensitive drum on the basis of the potential difference. The intermediate transfer belt is an endless belt-like member and rotationally moves in contact with the plural rotating rolls, the primary transfer roll, and the backup roll. The rotating rolls are cylindrical members supporting the movement of the intermediate transfer belt and rotate about the centers of the cylinders, respectively.

The primary transfer roll is a cylindrical member opposed to the photosensitive drum with the intermediate transfer belt interposed therebetween and causes a potential difference from the photosensitive drum to transfer the toner on the surface of the photosensitive drum to the surface of the intermediate transfer belt. The secondary transfer roll is a cylindrical member opposed to the backup roll with the intermediate transfer belt interposed therebetween and causes a potential difference from the backup roll to transfer the toner on the surface of the intermediate transfer belt to the surface of the recording medium at the transfer position. The plural carrying rolls 255 are cylindrical members carrying a sheet of paper to a position where the secondary transfer unit 254 performs the transfer operation and carrying the sheet to which the toner has been transferred to the position where the fixing unit 256 is disposed. The fixing unit 256 heats and presses the sheet of paper to which the toner has been transferred to fix the toner onto the sheet of paper.

Figure 4:
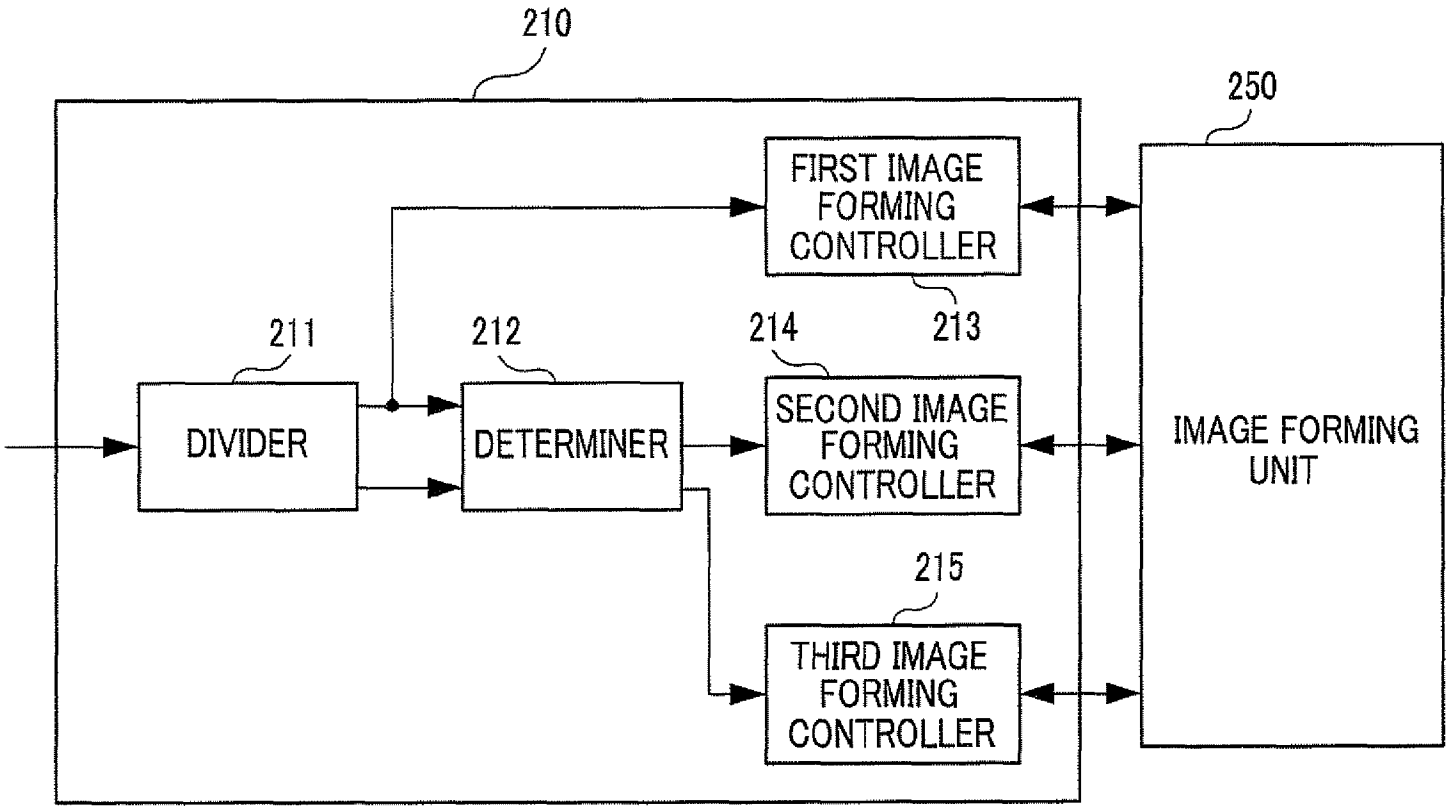
FIG. 4 is a diagram illustrating the functional blocks of a control unit of the image forming apparatus.

The functional blocks constructed as for hardware configuration by causing the control unit 210 to execute the functional program will be described with reference to FIG. 4.

The control unit 210 includes a separation potion 211, a determination portion 212, a first image forming controller 213, a second image forming controller 214, and a third image forming controller 215. The separation potion 211 separates the entirety of the image data into code image data representing a code image and non-code image data representing an image (non-code image) acquired by removing the code image from the entire image. The determination portion 212 determines an area where the code image and the non-code image overlap in the entire image area. The determination portion 212 corresponds to an example of the "determination section" described in the above-mentioned aspect.

The first image forming controller 213 controls the operation of the image forming unit 250 of forming a code image on a recording medium using the toner of Gy (the second image-forming material). Specifically, this operation is an operation, which is performed by the image forming unit 250, of developing image data of Gy representing the code image and transferring the developed image data to the recording medium to form the code image. The first image forming controller 213 and a part of the image forming unit 250 other than the developing devices 2511 serve as the "first image forming unit" described in the above-mentioned aspect in cooperation with each other. The second image forming controller 214 controls the operation of the image forming unit 250 of forming the non-code image in an area other than the area determined by the determination portion 212 on the recording medium using at least one toner (toner of Y, M, C, and K) other than the toner of Gy. That is, the second image forming controller 214 forms the image using at least one toner of Y, M, C, and K and may additionally form an image using the toner of Y, M, C, K, and Gy as the second toner to the fifth toner. In other words, the second image forming controller 214 does not form an image using only the toner of Gy. Specifically, this operation is an operation, which is performed by the image forming unit 250, of forming a non-code image as a whole on the recording medium by developing the image data of Y, M, C, K, and Gy separated from the non-code image and superimposing the developed images to mix the colors. The second image forming controller 214 and a part of the image forming unit 250 other than the developing devices 2511 serve as the "second image forming unit" described in the above-mentioned aspect in cooperation with each other. The third image forming controller 215 controls the operation of the image forming unit 250 of forming the non-code image in the area determined by the determination portion 212 on the recording medium using only the toner of Y, M and C (the third image-forming material). Specifically, this operation is an operation, which is performed by the image forming unit 250, of forming a non-code image as a whole on the recording medium by developing the image data of Y, M, and C separated from the non-code image and superimposing the developed images to mix the colors. The third image forming controller 215 and a part of the image forming unit 250 other than the developing devices 2511 serve as the "third image forming unit" described in the above-mentioned aspect in cooperation with each other.

The operation of the image forming apparatus 20 according to the first embodiment will be described below.

First, the image forming apparatus 20 takes the opportunity of receiving the entirety of the image data transmitted from the information processor 10 to start its operation. The received entirety of the image data is supplied to the separation portion 211 via the communication unit 220. The separation portion 211 separates the supplied entirety of the image data into the code image data and the non-code image data. The separation portion 211 supplies the separated code image data and the non-code image data to the determination portion 212 and supplies the separated code image data to the first image forming controller 213. Then, the determination portion 212 determines the area where the image represented by the code image data overlaps with the image represented by the non-code image data. The determination portion 212 supplies data representing the determined area to the second image forming controller 214 and the third image forming controller 215 along with the non-code image data. The first image forming controller 213 controls the operation of the image forming unit 250 of forming the code image using the toner of Gy. The second image forming controller 214 controls the operation of the image forming unit 250 of forming the non-code image in an area other than the area determined by the determination portion 212 using at least one toner of Y, M, C, and K. The third image forming controller 215 controls the operation of the image forming unit 250 of forming the non-code image using only the toner of Y, M, and C.

Figure 5:
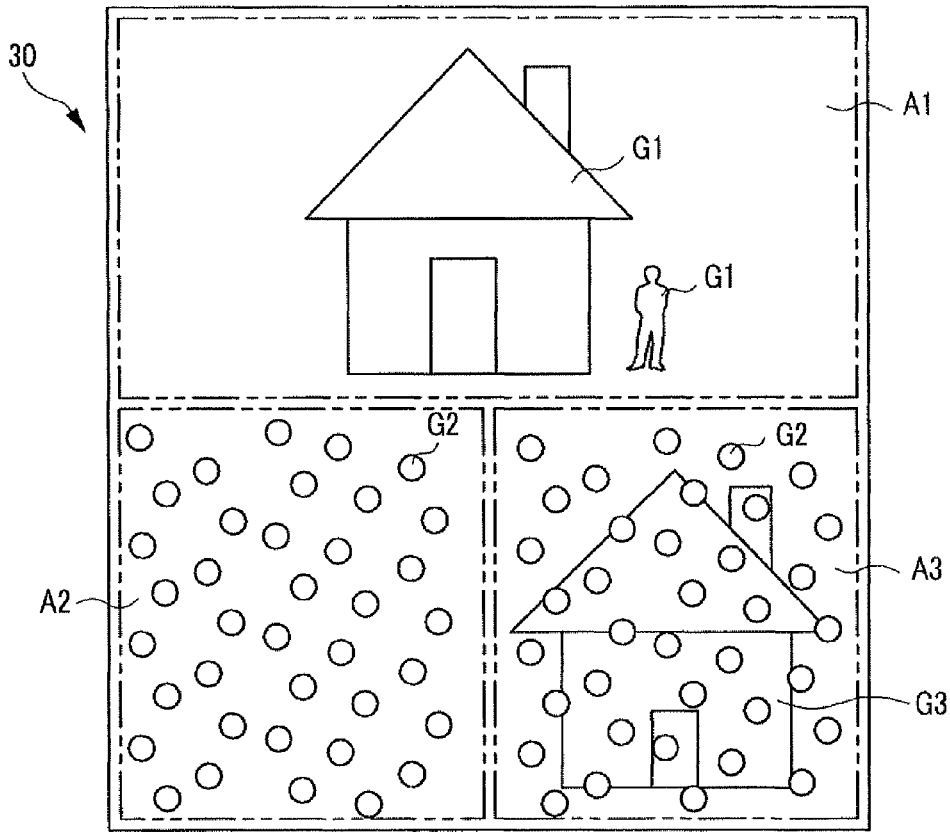
FIG. 5 is a diagram schematically illustrating an example of an image formed by the image forming apparatus.

By causing the image forming unit 20 to perform the above-mentioned operations, an image including the code image is formed on the recording medium 30. FIG. 5 is a diagram schematically illustrating an example of an image formed on the recording medium 30 by the image forming apparatus 20. G1 and G3 shown in FIG. 5 are images (non-code images) such as a background and a person other than the code image. G2 is an image of dots painted with gray and represents an image (code image) representing encoded information depending on the shapes, sizes, and arrangements of the dots. For example, information for identifying a non-code image, information indicating the details of the non-code image, and information to be added to the details of the non-code image are encoded and buried in the code image G2. The code image G2 is an image to be read by the reader 40 and the non-code images G1 and G3 are images not to be read by the reader 40. In FIG. 5, the dots are schematically marked by white circles for the purpose of simplification.

An area A1 is an area in which only the non-code image is formed and the non-code image formed in the area A1 is G1. The non-code image G1 is formed using at least one toner of Y, M, C, and K. An area A2 is an area in which the code image G2 is formed. An area A3 is an area in which the code image G2 and the non-code image are formed to overlap with each other and the non-code image formed in the area A3 is G3. The non-code image G3 is formed using only the toner of Y, M, and C. The code image G2 is formed using the toner of Gy in any of the areas A2 and A3. In this embodiment, the area A3 is a rectangular area including the non-code image G3 therein, but is not limited to this shape and the area may have a different shape or size. For example, the outline of the non-code image G3 may have an angled shape or may have a circular shape or a polygonal shape circumscribing the non-code image G3.

Since the image shown in FIG. 5 is formed on the recording medium 30 with a white background, the color (gray) of the code image G2 is closer to the color (white) of the recording medium 30 (that is, the color difference is smaller), compared with the case where it is formed with the toner of K and thus the code image is inconspicuous to the human eye. On the other hand, the ease of reading when the reader 40 reads the code image G2 depends on the degree of absorption (or reflection) of the reading light by the code image G2. In this embodiment, the reader 40 applies infrared light as the reading light and reads the part of which the reflected light is weaker than that of the peripheral part as the code image G2. The toner of Gy forming the code image G2 has a greater ratio (absorptance) of infrared absorption than that of the recording medium 30 with a white background. Accordingly, the code image G2 is recognized as an area other than the white background area of the recording medium 30 by the reader 40. The infrared light is light of a wavelength absorbed by the toner of K and Gy and is light of which the ratio of absorption (absorptance) by the toner of Y, M, and C is not greater than the ratio of absorption by the toner of Gy. The infrared light is an example of the "light of a wavelength absorbed by the first image-forming material" described in the above-mentioned aspect. Accordingly, the code image G2 has infrared absorptance greater than that of the non-code image G3 formed with only the toner of Y, M, and C, and the reader 40 reads the code image G2 without being influenced by the image G3. As the infrared absorptance by the code image G2 becomes greater, the difference in the reflected light of the reading light from the peripheral area (the white background or the non-code image G3) becomes greater and the code image can be more easily read by the reader 40. As described above, compared with the case where the code image is formed using the toner of K, the code image included in an image formed by the image forming apparatus 20 is more unobtrusive to the human eye, even without using the pigment such as a transparent pigment absorbing infrared light used only for forming the code image.

In order to make the code image G2 in the image shown in FIG. 5 inconspicuous to the human eye, it is preferable that the concentration of the toner of Gy is lowered to cause the color of the code image G2 to be closer to the color (white) of the recording medium. However, in this case, the absorptance of the reading light is also lowered. Hereinafter, when the density of the image formed with the toner of Gy is changed by changing the amount of the black pigment contained in the toner of Gy, the variation of the color difference between the color of the image and the white background and the variation of the optical absorptance by the image are measured and compared. In this measurement, light of a wavelength of 490 nm is used as an example of short-wavelength light and light of a wavelength of 740 nm is used as an example of long-wavelength light.

Figure 6:
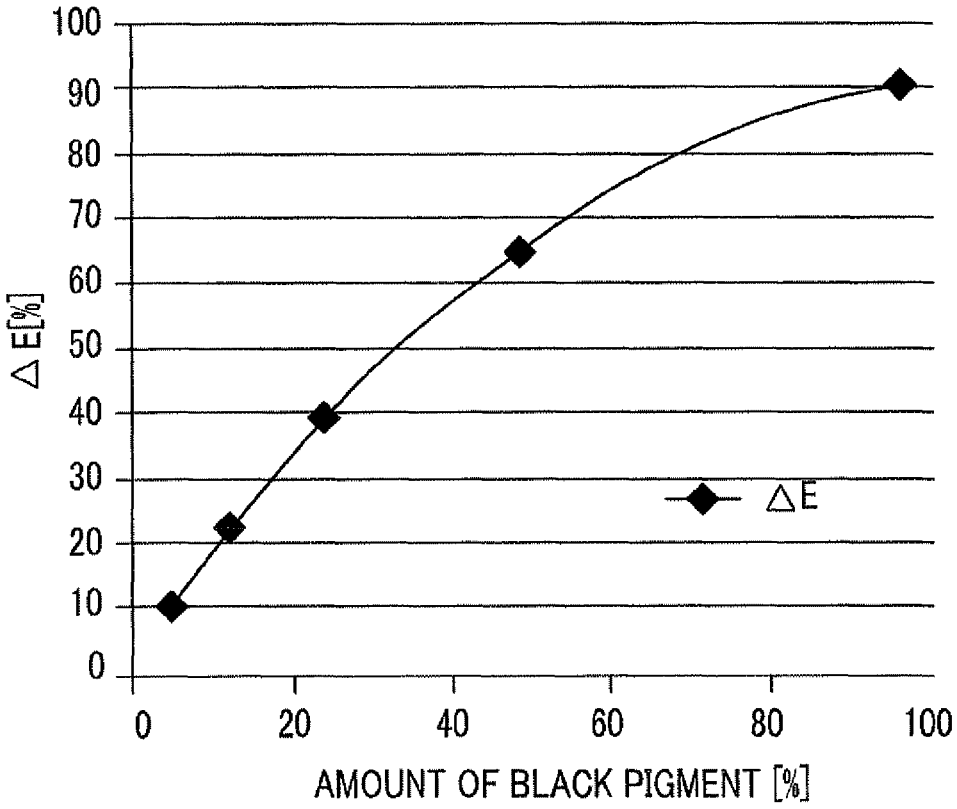
FIG. 6 is a graph illustrating a color difference ΔE between an image formed with toner of Gy and a white background.

FIG. 6 is a graph illustrating the measurement result of the color difference ΔE between images formed with the toners of Gy having different amount ratios of black pigment and the white background of the recording medium. In FIG. 6, the color difference ΔE is shown, color difference 0 represents that the image has the completely same color as the recording medium 30, and color difference 100 represents that it is the color difference between ideal white paper and an ideal inky-black image (Note: the color difference may be greater than 100 depending on the colors). In this graph, when the amount of black pigment contained in the toner of K is 100%, the color differences ΔE are 90.5, 62.8, 37.8, 20.9, and 8.9 with the amounts of black pigment of 100%, 50%, 25%, 13%, and 5%, respectively.

Figure 7:
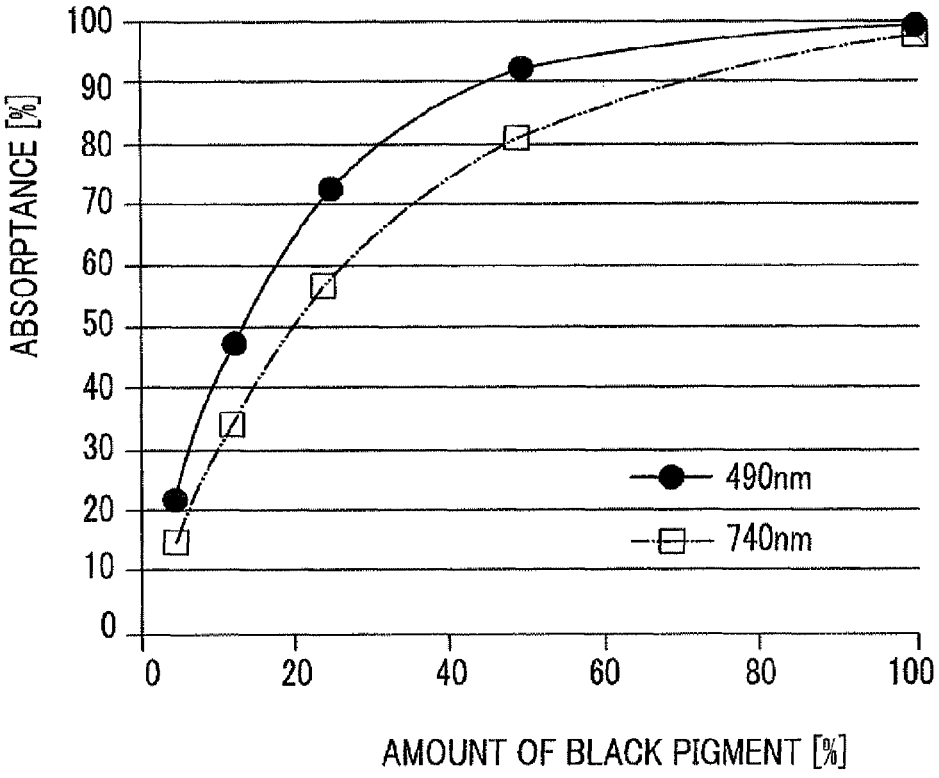
FIG. 7 is a graph illustrating optical absorptance in an image formed with the toner of Gy.

On the other hand, FIG. 7 is a graph illustrating the optical absorptance at wavelengths of 490 nm and 740 nm in images formed with the toner of Gy having different amounts of black pigment. When the amounts of black pigment are 100%, 50%, 25%, 13%, and 5%, the optical absorptances at the wavelength of 490 nm are 99.4%, 92.2%, 72.2%, 47.2%, and 22.6%, respectively, and the optical absorptances at the wavelength of 740 nm are 96.7%, 81.8%, 57.3%, 34.7%, and 15.7%, respectively.

In the images (the code image in this embodiment) formed with the toner of Gy, as the color difference ΔE becomes smaller, it is more difficult to see the difference between the white background and the color and thus the image becomes more inconspicuous. On the other hand, when the light of these wavelengths is read and used as light, the difficulty in reading the code image with the machine such as the reader 40 or the like increases as the optical absorptance decreases. Here, in the measurement shown in FIGS. 6 and 7, as the amount of black pigment decreases, that is, as the concentration of the toner of Gy decreases, the color difference ΔE and the absorptance also decrease, but the degree of decrease in the absorptance is smaller. For example, the color difference ΔE and the absorptance are compared when the amount of black pigment decreases from 100% to 50%. Then, while the color difference ΔE decreases by 69.4 (62.8÷90.5), the optical absorptance at the wavelength of 490 nm decreases by 92.8% (92.2%÷99.4%) and the optical absorptance at the wavelength of 740 nm decreases by 84.6%(81.8%÷96.7%). Accordingly, the decreasing degree of the optical absorptance is smaller. The color difference and the absorptance are compared when the amount of black pigment decreases from 100% to 5%. Then, while the color difference ΔE decreases by 9.8 (8.9÷90.5), the optical absorptance at the wavelength of 490 nm decreases by 22.7% (22.66÷99.4%) and the optical absorptance at the wavelength of 740 nm decreases by 16.2% (15.7%÷96.7%). Accordingly, the decreasing degree of the optical absorptance is smaller.

As a result, in an image including a code image formed on the recording medium 30 with the toner of Gy, the code image is more inconspicuous to the human eye than a code image formed with the toner of K and the difficulty in causing the reader 40 to read the code image is suppressed.

Second Embodiment

An image processing system 1*a* including an information processor 10*a* according to a second embodiment of the invention will be described below. The difference from the first embodiment will be described.

Figure 8:
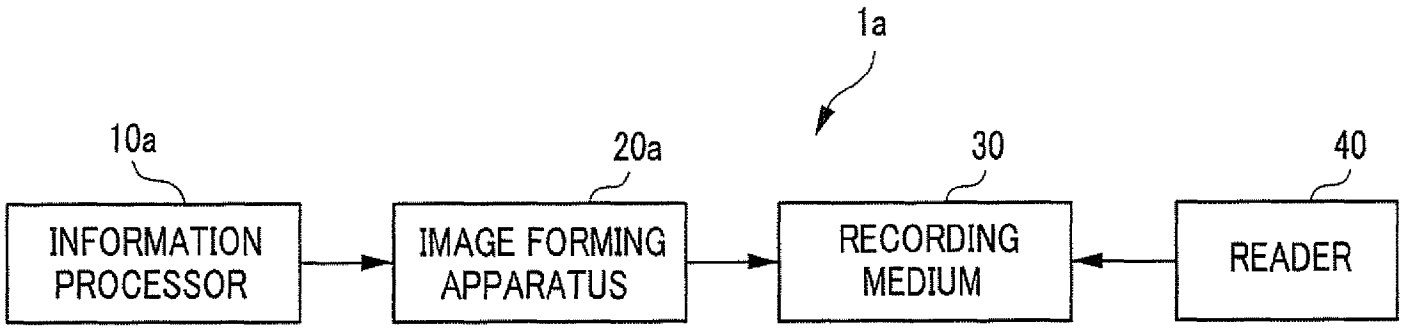
FIG. 8 is a block diagram illustrating the entire configuration of an image processing system according to another exemplary embodiment of the invention.

FIG. 8 is a block diagram illustrating the entire configuration of the image processing system 1*a* including the information processor 10*a*. The image processing system 1*a* includes an information processor 10*a*, an image forming apparatus 20*a*, a recording medium 30, and a reader 40.

Figure 9:
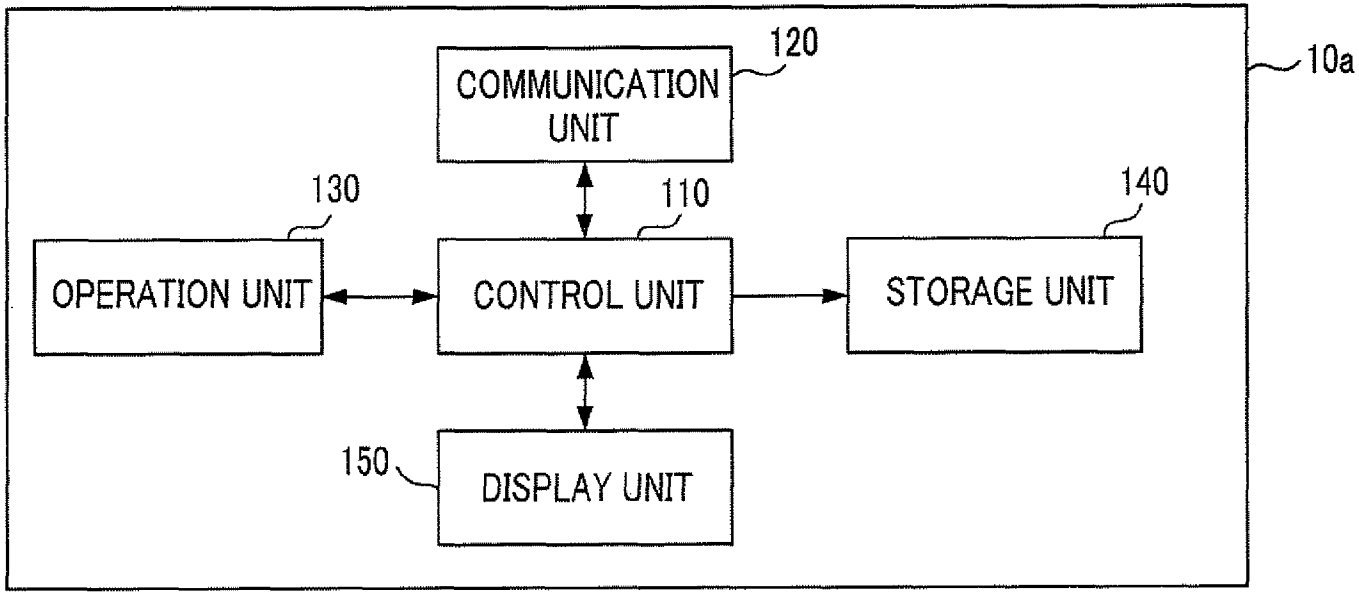
FIG. 9 is a block diagram illustrating the hardware configuration of an information processor.

FIG. 9 is a block diagram illustrating the hardware configuration of the information processor 10*a*. The information processor 10*a* includes a control unit 110, a communication unit 120, an operation unit 130, a storage unit 140, and a display unit 150. The control unit 110 includes a CPU, a ROM, and a RAM. The CPU constructs various functional blocks by loading a functional program stored in the ROM or the storage unit 140 into the RAM and executing the loaded functional program. The RAM also serves as an area temporarily storing data and the like at the time of causing the CPU to execute the functional program.

The communication unit 120 includes an interface used to transmit and receive data to and from an external device and outputs, for example, image data and the like to the image forming apparatus 20*a* shown in FIG. 8. The operation unit 130 includes operation elements such as a mouse and a keyboard and supplies operation data indicating the operation details to the control unit 110 in response to a user's operation. The storage unit 140 includes a storage device such as an HDD and stores, for example, all the image data or code image data. The display unit 150 is, for example, a liquid crystal display device.

Figure 10:
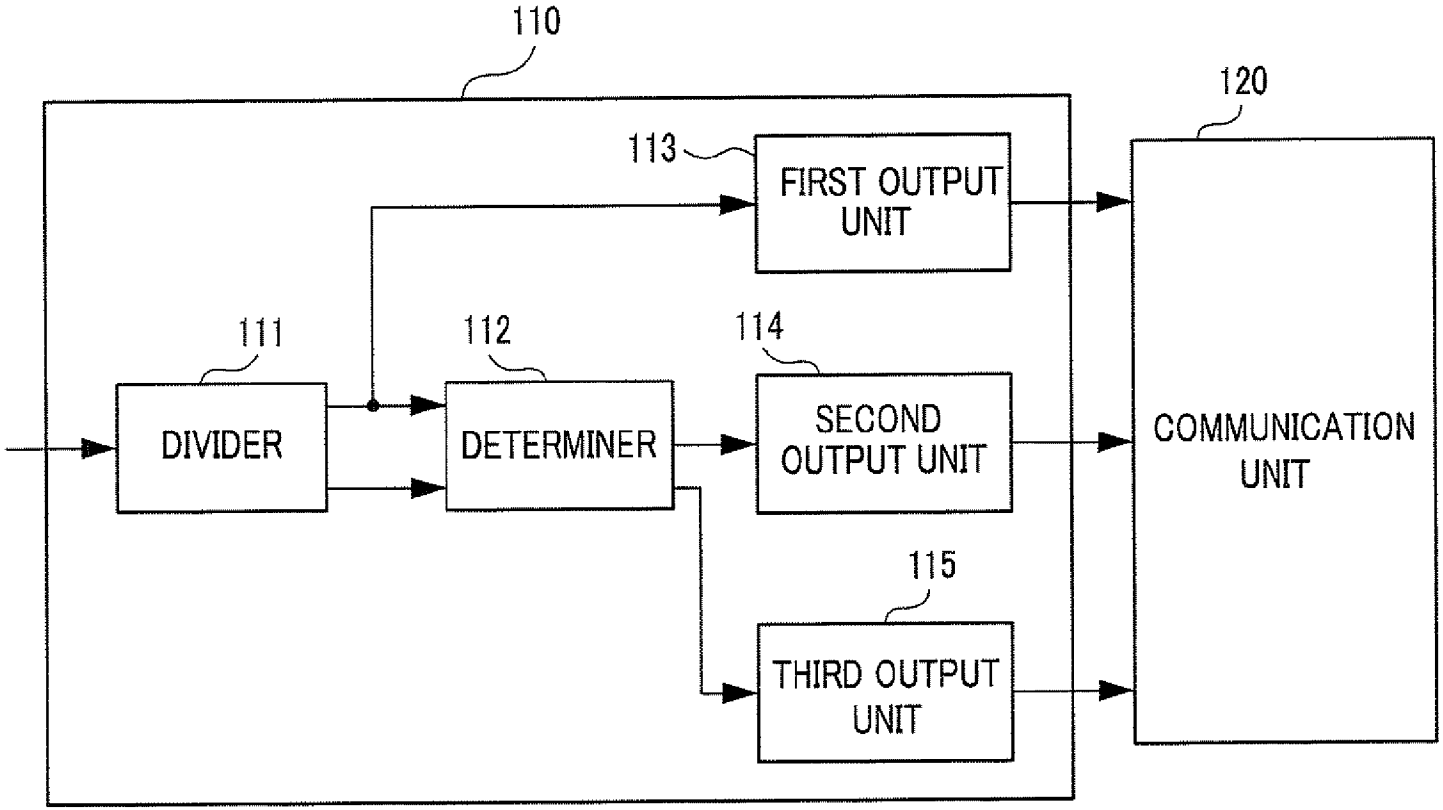
FIG. 10 is a diagram illustrating the functional blocks of a control unit of the information processor.

The functional blocks constructed by causing the control unit 110 to execute a functional program in the above-mentioned hardware configuration will be described below with reference to FIG. 10.

The control unit 110 includes a separation portion 111, a determination portion 112, a first output unit 113, a second output unit 114, and a third output unit 115. The separation portion 111 divides the entirety of the image data into code image data representing a code image and non-code image data representing a non-code image. The determination portion 112 determines an area where the code image and the non-code image overlap in the entire image area. The determination portion 112 corresponds to an example of the "determination section" described in the above-mentioned aspect.

The first output unit 113, the second output unit 114, and the third output unit 115 output data representing an image and data instructing the formation of the image represented by the data to the image forming apparatus 20*a* shown in FIG. 8 via the communication unit 120. Specifically, the data output from the first output unit 113 includes data instructing the formation of a non-code image in an area other than the area determined by the determination portion 112 using at least one toner (the toner other than Gy) of Y, M, C, and K and non-code image data representing the non-code image. The data output from the second output unit 114 includes data instructing the formation of a code image on a recording medium using the toner of Gy and code image data representing the code image, and is an example of the "first data" described in the above-mentioned aspect. The data output from the third output unit 115 include data instructing the formation of a non-code image in the area determined by the determination portion 112 using only the toner of Y, M, and C and non-code image data representing the non-code image, and is an example of the "second data" described in the above-mentioned aspect. As described above, the information processor 10*a* is an apparatus outputting image data and data instructing the formation of an image to the image forming apparatus 20*a* and is an example of the "output device" and the "output unit" described in the above-mentioned aspect.

Figure 11:
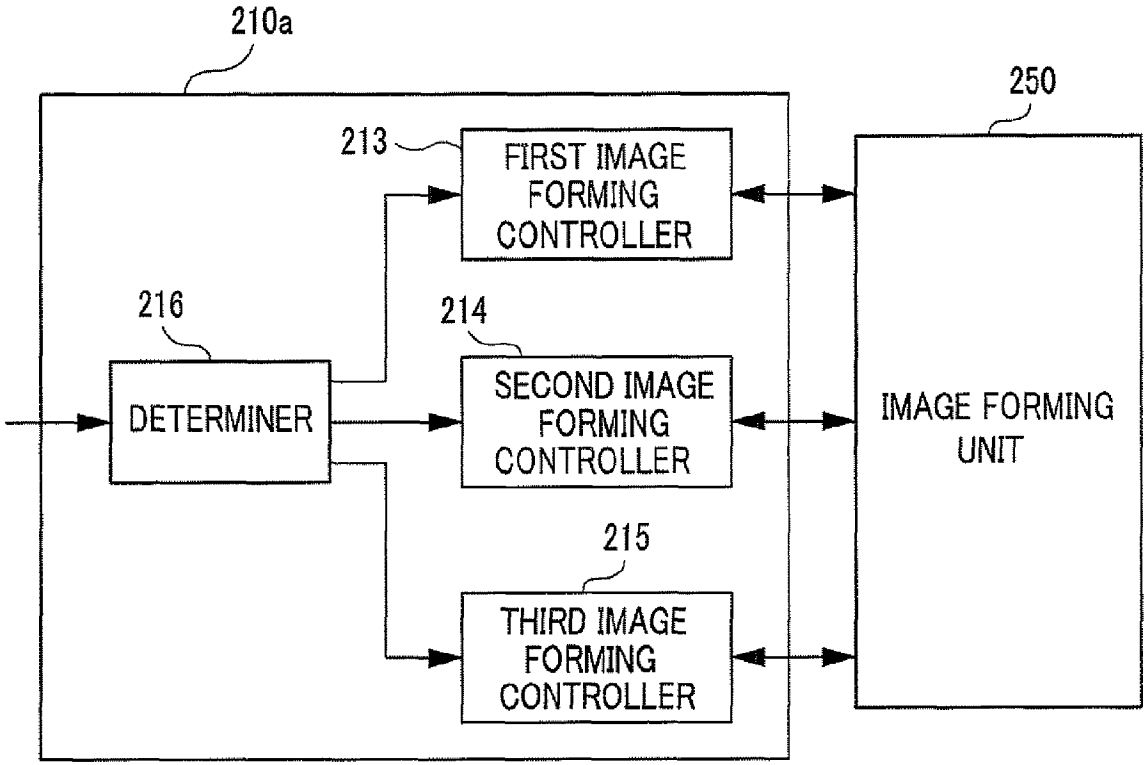
FIG. 11 is a diagram illustrating the functional blocks of a control unit of the image forming apparatus.

The image forming apparatus 20*a* has a hardware configuration common to the image forming apparatus 20 according to the first embodiment and they are different from each other only in the functional blocks constructed by the control unit. To facilitate the explanation, the image forming apparatus and the control unit will be described as the image forming apparatus 20*a* and the control unit 210*a*. FIG. 11 is a diagram illustrating the functional blocks constructed by the control unit 210*a* of the image forming apparatus 20*a* according to the second embodiment. FIG. 11 is different from FIG. 4, in that a determination portion 216 is disposed instead of the separation portion 211 and the determination portion 212. The determination portion 216 determines whether to which of a first image forming controller 213, a second image forming controller 214, and a third image forming controller 215 data should be supplied from the details of image data and data instructing the formation of the image represented by the image data. For example, when the data is output from the first output unit 113 shown in FIG. 10, the determination portion 216 supplies the data to the first image forming controller 213. When the data is output from the second output unit 114 shown in FIG. 10, the determination portion 216 supplies the data to the second image forming controller 214. When the data is output from the third output unit 115 shown in FIG. 10, the determination portion 216 supplies the data to the third image forming controller 215.

The operation of the control unit 110 of the information processor 10*a* according to the second embodiment will be described below.

In the state where the entirety of the image data is generated, the control unit 110 takes the opportunity of the instruction to form the entire image based on the user's operation to start its operation. First, the generated entirety of the image data is supplied to the separation portion 111. The separation portion 111 divides the supplied entirety of the image data into code image data and non-code image data. The separation portion 111 supplies the divided code image data and the divided non-code image data to the determination portion 112 and supplies the divided code image data to the first output unit 113. The determination portion 112 determines an area where an image represented by the divided code image data and an image represented by the divided non-code image data overlap. The determination portion 112 supplies data representing the determined area to the second output unit 114 and the third output unit 115 along with the non-code image data. The first output unit 113 outputs data instructing the formation of the code image on a recording medium using the toner of Gy and data representing the code image to the image forming apparatus 20*a*. The second output unit 114 outputs data instructing the formation of the non-code image in an area other than the area determined by the determination portion 112 on the recording medium using at least one toner of Y, M, C, and K and data representing the non-code image to the image forming apparatus 20*a*. The third output unit 115 outputs data instructing the formation of the non-code image in the area determined by the determination portion 112 on the recording medium using only the toner of Y, M, and C and data representing the non-code image to the image forming apparatus 20*a*. The image forming apparatus 20*a* forms, for example, the image shown in FIG. 5 by receiving the data output from the information processor 10*a* as described above.

Modifications

The first and second embodiments are only examples for putting the invention into practice, can be modified in the following various forms, and may be combined as needed.

Modification 1

In the first and second embodiments, the processes may be performed using code image data and non-code image data (that is, in a divided state from the first time) instead of the entirety of the image data. Specifically, the information processor 10 or 10*a* may generate the code image data and the non-code image data, or may acquire the data from an external device and store the acquired data in advance. In this case, the separation portion 111 or 211 may not perform the process of dividing the image data or may not be installed.

Modification 2

The image forming apparatus according to the exemplary embodiments of the invention may include combinations of various toners including toner of other colors in addition to the toner of the above-mentioned five colors (Y, M, C, K, and Gy). For example, the image forming apparatus may include toner of two colors of black (K) and gray (Gy) or may include toner of three colors or four colors including other colors in addition thereto. The image forming apparatus may include toner of six, seven, or more colors including toner of light magenta or light cyan in addition to the above-mentioned five colors (Y, M, C, K, and Gy). In any case, the image forming apparatus has only to include first toner containing a colored pigment and second toner of which the concentration of the pigment is lower than that of the first toner. For example, the image forming apparatus may have the toner of magenta as the first toner and the toner of light magenta as the second toner. The image forming apparatus may have the toner of cyan as the first toner and the toner of light cyan as the second toner. The combination of the first toner and the second toner may not have a strictly common color, as long as the color of the second toner is more unobtrusive to the human eye with respect to the white background of the recording medium 30 than the color of the first toner.

It is preferable that the image forming apparatus forms the non-code image in the area where the code image and the non-code image overlap using only one or more toner types (the third toner) of which the optical absorptance at the wavelength absorbed by the first toner is not greater than that of the second toner. In this case, the influence of the non-code image on the reading of the code image is reduced, compared with the case where the non-code image is formed using toner other than the third toner.

Modification 3

The image processing system according to the exemplary embodiment of the invention may employ light other than infrared light as reading light. The reading light may be, for example, ultraviolet light or visible light, but is preferably light other than visible light. When the reading light is visible light, a part formed with the color indicated by the reading light in the non-code image may be recognized as a code image. When the reading light is light other than the visible light, the code image can be read without being influenced by the absorptance of visible light by the non-code image.

Modification 4

In the first and second embodiments, the code image to be formed may include toner other than the toner of Gy (the second image-forming material). In this case, the code image to be formed in this modification preferably has a lower concentration or a smaller color difference from the color of the recording medium 30, compared with the code image formed with the toner of K. Preferably, when the former (Gy) code image is compared with the latter (K) code image, the decrease in the optical absorptance at the wavelength of the reading light is smaller than the decrease in the color difference ΔE. Accordingly, compared with the case where the code image is formed with the toner of K, the code image is more unobtrusive to the human eye and the difficulty in reading the code image by the use of the reader 40 is more suppressed.

Modification 5

In the first and second embodiments, the background of the recording medium 30 is not limited to white but may be another color. In this case, the recording medium 30 preferably has a color of which the concentration is lower than that of the color (gray) of the image formed with the toner of Gy (the second image-forming material). Alternatively, the recording medium 30 preferably has a color of which the color difference from the code image is smaller than the color difference from the non-code image. Accordingly, compared with the case where the code image is formed with the toner of K, the code image is more unobtrusive to the human eye.

Modification 6

In the first and second embodiments, another type may be used as the code image, as long as it represents the encoded information. The code image may be a one-dimensional code such as a barcode or a two-dimensional code such as a QR (Quick Response) code (registered trademark).

Modification 7

In the first and second embodiments, the image (that is, the code image G2) read by the reader 40 is not limited to representation of the encoded information. This image may be, for example, an image of letters or numerals or simple graphics or figures. This image has only to be read by the reader 40 on the basis of the fact that the reflectance of the reading light is smaller than that of the peripheral region. In other words, this image is an image which the reader 40 desires to read. On the contrary, an image which the reader 40 is not intended to be read corresponds to the non-code image in the above-mentioned embodiments.

Modification 8

The invention can be specified as any of a recording medium and an image processing system including a reader, as well as the image forming apparatus and the information processor. The invention may be specified as a program allowing a computer to serve as the information processor. The program may be provided in the form of a recording medium such as an optical disc in which the program is recorded or in the form in which the program is downloaded to the computer via the Internet and is installed for use.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus for forming an image on a recording medium comprising:

a first image-forming material that contains a colored pigment and a second image-forming material that contains the colored pigment having a concentration lower than that of the first image-forming material;

a first image forming unit that forms a code image representing encoded information on the recording medium using the second image-forming material;

a second image forming unit that forms a first non-code image at a position other than the position of the code image on the recording medium using an image-forming material other than the second image-forming material; and a third image-forming material in which the optical absorptance corresponding to that of the colored pigment is not greater than that of the second image-forming material;

a determination section that determines an area in which the code image and a second non-code image overlap; and a third image forming unit that forms the second non-code image in only the area determined by the determination section on the recording medium using the third image-forming material.

2. The image forming apparatus according to claim 1, wherein the image-forming material other than the second image-forming material contains the first image-forming material.

3. The image forming apparatus according to claim 2, wherein the colored pigment of the first image-forming material is black.

4. The image forming apparatus according to claim 1, wherein the colored pigment of the first image-forming material is black.

5. The image forming apparatus according to claim 1, wherein the third image-forming material is selected from yellow, cyan, and magenta image-forming materials.

6. The image forming apparatus according to claim 1, wherein the first image forming unit includes a first image forming controller;

the second image forming unit includes a second image forming controller; and the third image forming unit includes a third image forming controller.

7. An output device for forming an image on a recording medium comprising:

a control unit that generates first data and second data, the first data instructing that a code image out of image data, the image data including the code image representing encoded information and a first non-code image, should be formed on the recording medium using a second image-forming material, the second data instructing that the non-code image out of the image data should be formed at a position other than the position of the code image on the recording medium using an image-forming material other than the second image-forming material; and a communication unit that transmits the first data and the second data to an image forming apparatus having a first image-forming material that contains a colored pigment and the second image-forming material that contains the colored pigment having a concentration lower than that of the first image-forming material, the image forming apparatus further including a first image forming unit that forms the code image;

a second image forming unit that forms the first non-code image;

a third image-forming material in which the optical absorptance corresponding to that of the colored pigment is not greater than that of the second image-forming material;

a determination section that determines an area in which the code image and a second non-code image overlap; and a third image forming unit that forms the second non-code image in only the area determined by the determination section on the recording medium using the third image-forming material.

8. The output device according to claim 7, wherein the first data includes code image data and the second data includes non-code image data.

9. A non-transitory computer-readable medium for forming an image on a recording medium storing a program allowing a computer to function as an output device, the output device comprising:

a control unit that generates first data and second data, the first data instructing that a code image out of image data, the image data including the code image representing encoded information and a first non-code image, should be formed on the recording medium using a second image-forming material, the second data instructing that the non-code image out of the image data should be formed at a position other than the position of the code image on the recording medium using an image-forming material other than the second image-forming material; and a communication unit that transmits the first data and the second data to an image forming apparatus having a first image-forming material that contains a colored pigment and the second image-forming material that contains the colored pigment having a concentration lower than that of the first image-forming material, the image forming apparatus further including a first image forming unit that forms the code image;

a second image forming unit that forms the first non-code image;

a third image-forming material in which the optical absorptance corresponding to that of the colored pigment is not greater than that of the second image-forming material;

a determination section that determines an area in which the code image and a second non-code image overlap; and a third image forming unit that forms the second non-code image in only the area determined by the determination section on the recording medium using the third image-forming material.

* * * * *